United States Patent [19]

Nishiyama

[11] 3,938,904

[45] Feb. 17, 1976

[54] PASSAGE STRUCTURES FOR USE IN ACQUIRING THE TECHNIQUES FOR DRIVING MOTOR CYCLES

[76] Inventor: Toshiki Nishiyama, No. 78, 4-chome, Uwa-machi, Yokosuka, Kanagawa, Japan

[22] Filed: Feb. 1, 1974

[21] Appl. No.: 438,702

[52] U.S. Cl. ..... 404/35; 404/42; 404/71

[51] Int. Cl.[2] ..... E01C 5/16

[58] Field of Search ..... 404/34, 42, 17, 2; 61/10, 61/16; 404/35, 71

[56] References Cited

UNITED STATES PATENTS

| | | | |
|---|---|---|---|
| 469,044 | 2/1892 | Jungbluth | 404/2 |
| 712,541 | 11/1902 | Jaques | 404/17 |
| 1,505,411 | 8/1924 | Newell | 404/35 |
| 2,386,020 | 10/1945 | Wendelken | 404/2 |
| 3,174,412 | 7/1961 | Boyd et al. | 404/2 |
| 3,820,912 | 6/1974 | Hughes | 404/35 |

*Primary Examiner*—Mervin Stein
*Assistant Examiner*—Steven Hawkins
*Attorney, Agent, or Firm*—Stewart and Kolasch, Ltd.

[57] ABSTRACT

A plurality of portable road-type structures which contain a variety of differently shaped surfaces to simulate driving conditions which might be experienced by an individual driving a vehicle, for example, a motorcycle. The portable road-type structures are used as an educational tool for giving the driver the fundamental knowledge and technique for driving a motorcycle before he is exposed to actual driving conditions.

15 Claims, 23 Drawing Figures

FIG. 1
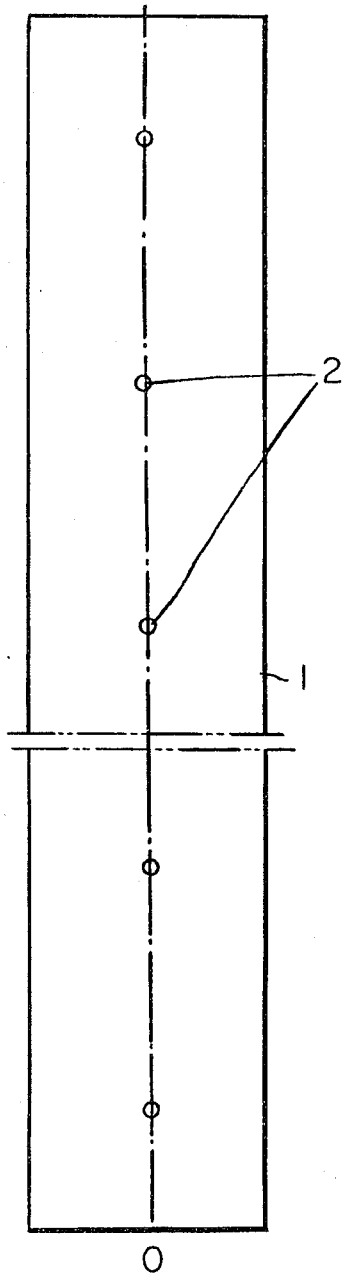
FIG. 2
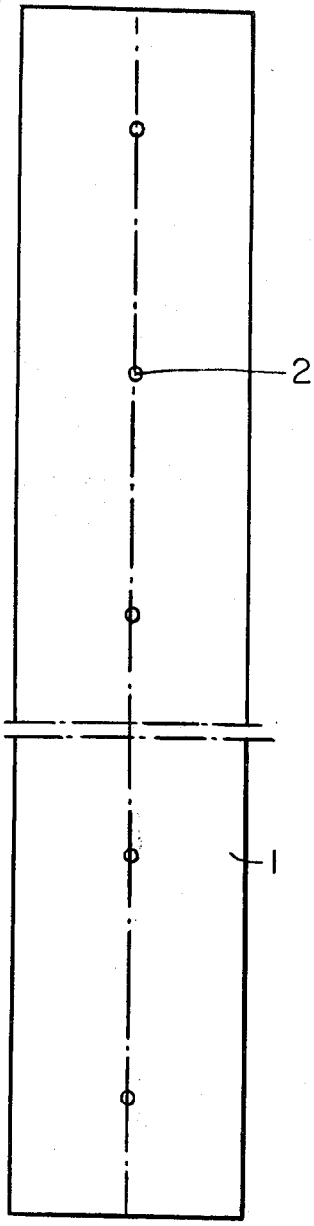
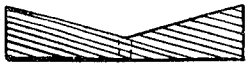
FIG. 1A
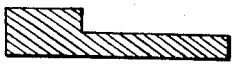
FIG. 1B
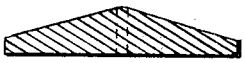
FIG. 2A FIG. 3
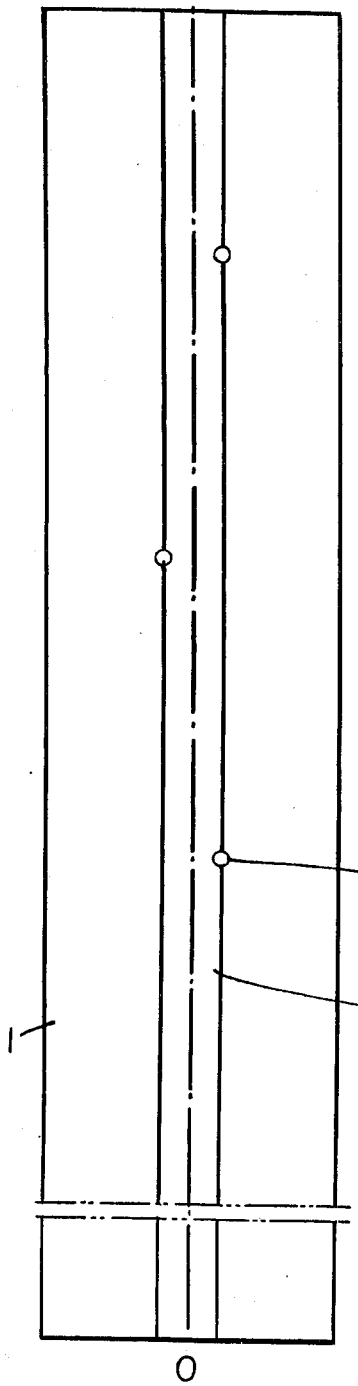
FIG. 4
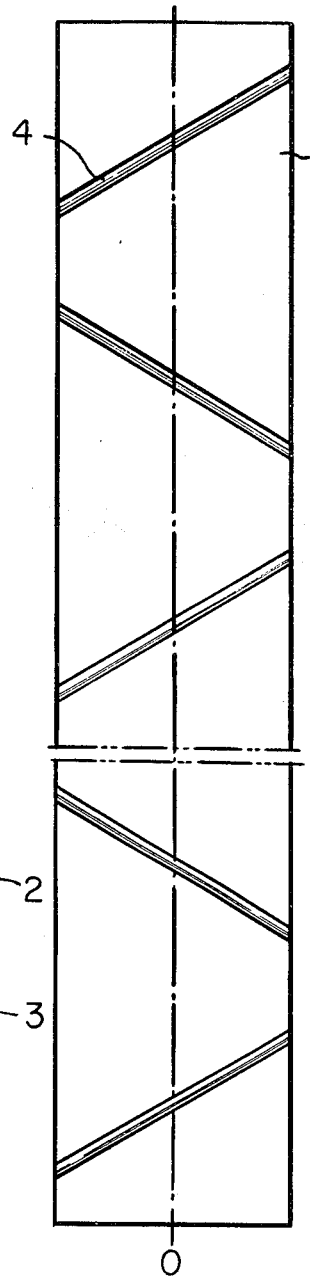
FIG. 5
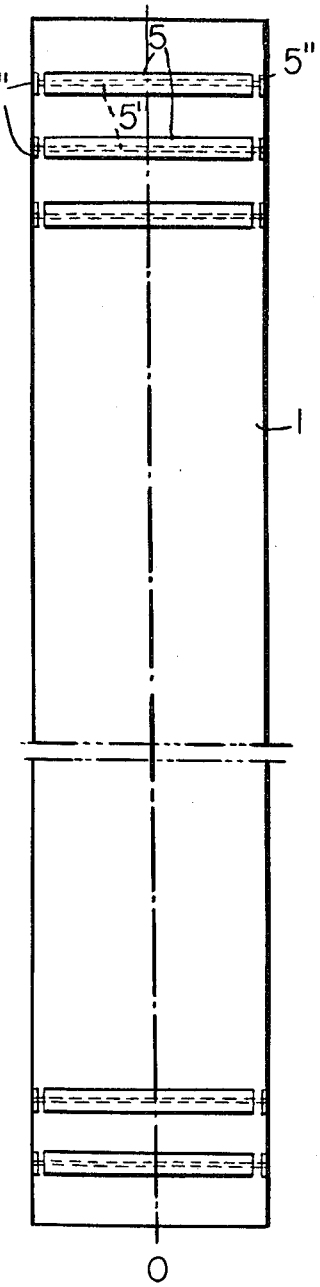
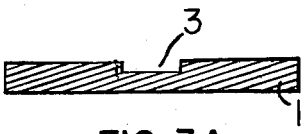
FIG. 3A FIG. 6
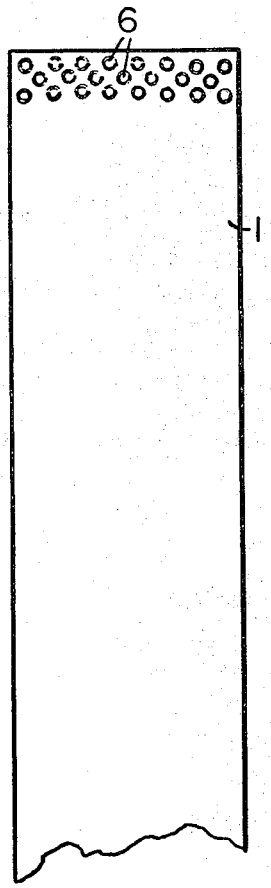
FIG. 7
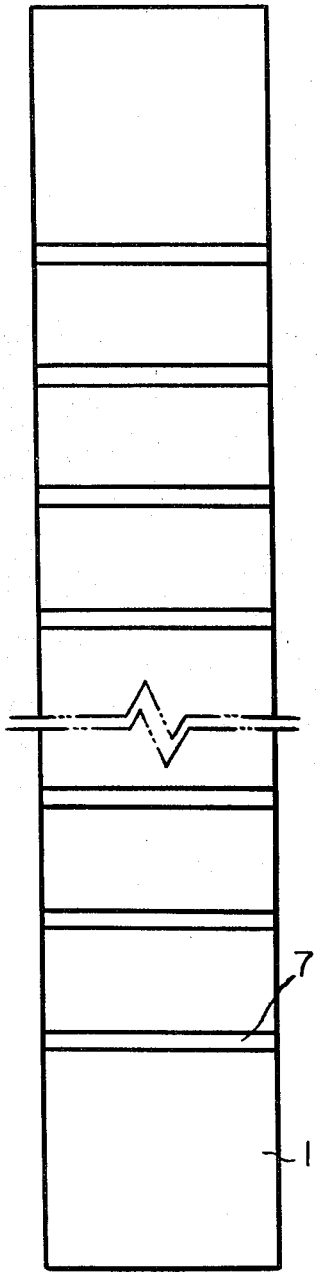
FIG. 7A
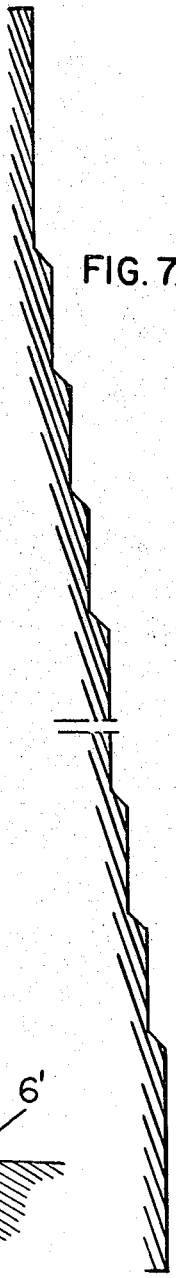
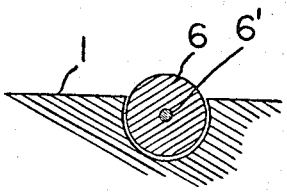
FIG. 6A FIG. 10
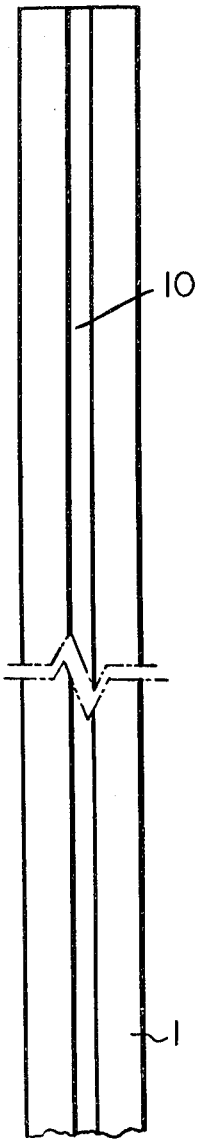
FIG. 11
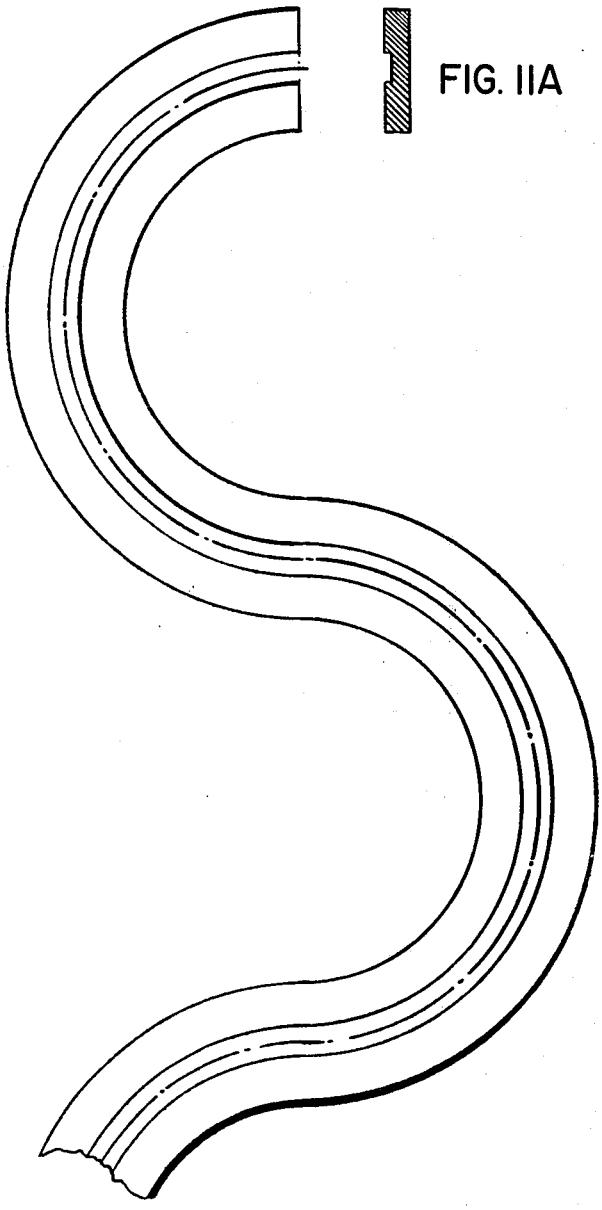
FIG. 11A a b 12
c

1

PASSAGE STRUCTURES FOR USE IN ACQUIRING THE TECHNIQUES FOR DRIVING MOTOR CYCLES

This invention relates to portable road-type structures for giving the driver fundamental knowledge and techniques for driving a motor cycle.

Recently, motor cycle driving has become very popular among the younger generation. However, most of the drivers begin driving a motor cycle without having any knowledge and techniques for driving it, and because of this fact traffic accidents involving motorcycles have sharply increased.

The object of the present invention is to provide various kinds of portable road-type structures which are formed on the basis of scientific analysis of driving techniques and which can be removably combined in blocks as desired in proper positions so as to enable two-wheeled motor cycle drivers to quickly obtain, under the same condition throughout the country, fundamental knowledge and concepts of driving techniques by driving on said passages portable roadways which simulate variable road conditions so that they can control the motor cycle safely and properly.

As the passage structures according to the present invention can be disassembled into several blocks and can be reassembled into a single unit, it is possible to take these blocks to a desired place and assemble them there.

It is one of the merits of the present invention that the passage structures can be installed at any desired place and taken easily to any other place.

The present invention will now be described, by way of examples, with reference to the accompanying drawings wherein:

FIG. 1 is a plan view of a passage roadway according to the first embodiment of the present invention, FIGS. 1—1 is a cross-sectional view of the roadway taken along a—a line, FIGS. 1—2 is another embodiment of the roadway having a stepped portion formed in the longitudinal direction, FIG. 2 is a plan view of a roadway according to the second embodiment of the present invention, FIGS. 2—1 is a cross-sectional view of the roadway taken along b—b line, FIG. 3 is a plan view of a roadway according to a third embodiment of the present invention, FIGS. 3—1 is a cross-sectional view of the roadway along a—a line.

Figure 8A:
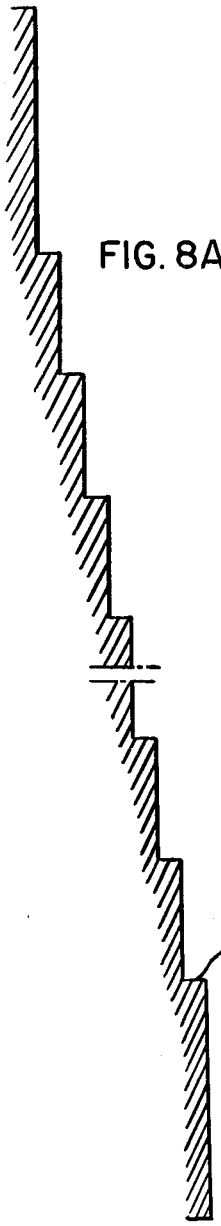
Figure 8:
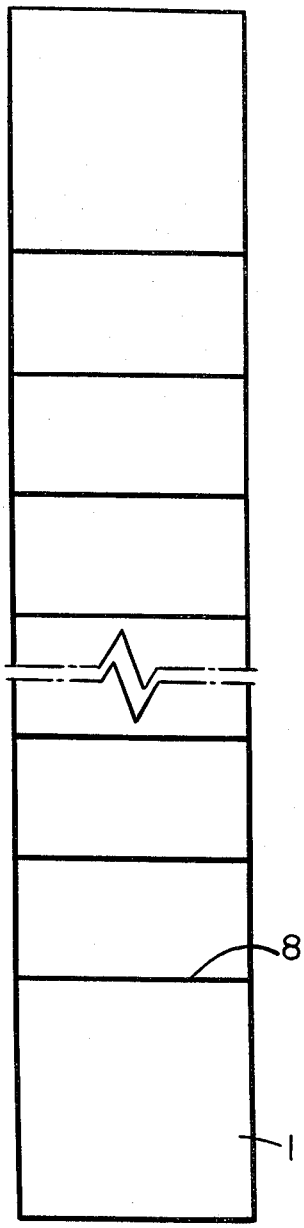
Figure 9:
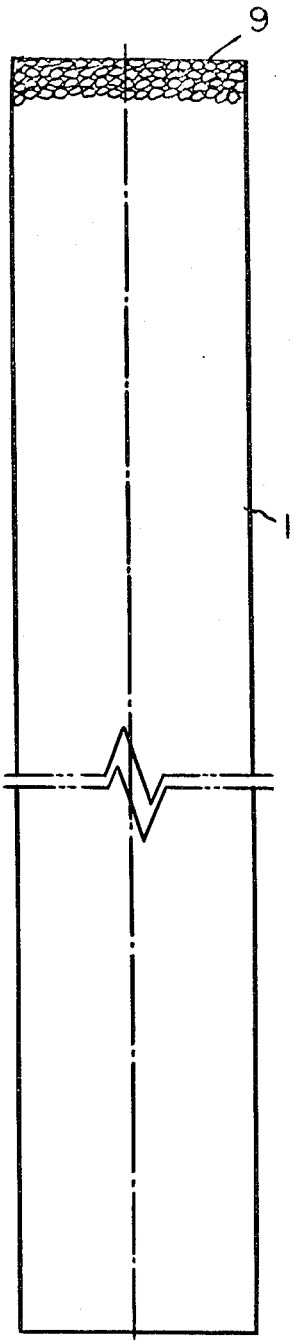
Figures 12, 12A, 12B, 12C:
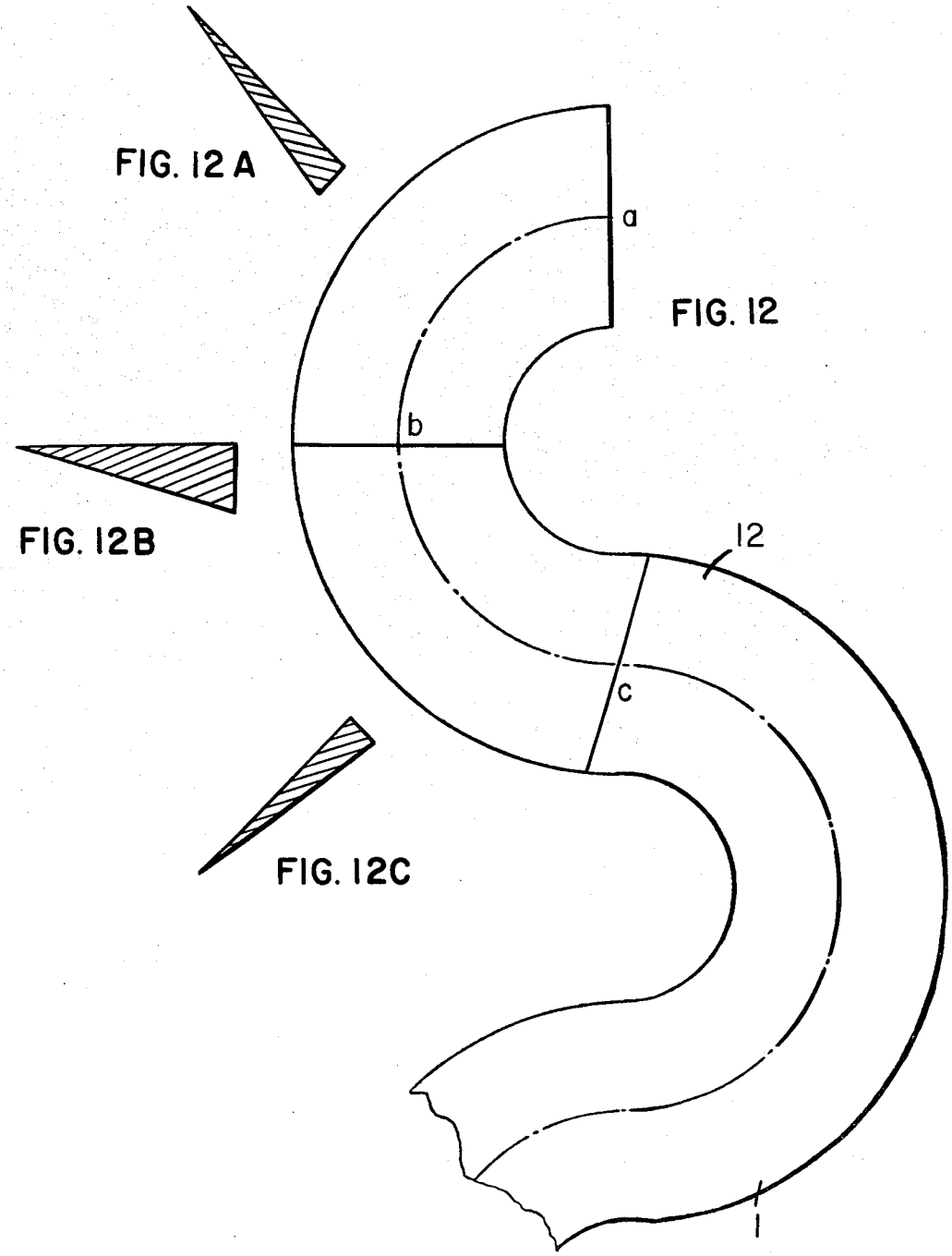

FIGS. 4 and 5 show a plan view of a roadway according to fourth and fifth embodiments of the present invention, respectively, FIG. 6 is a plan view of a roadway according to the sixth embodiment of the present invention, FIGS. 6—1 is a fragmentary cross-sectional view of the roadway shown in FIG. 6, FIGS. 7 and 8 show a plan view of a roadway according to seventh and eighth embodiments of the present invention, respectively, FIGS. 7—1 and 8—1 are side elevational views of the roadways shown in FIGS. 7 and 8, FIG. 9 is a plan view of a roadway according to the ninth enbodiment of the present invention, FIGS. 10 and 11 show a plan view of a roadway according to the tenth and eleventh embodiments of the present invention respectively, FIG. 12 is a plan view of a roadway according to the twelveth embodiment of the present invention, and FIGS. 12A, 12B and 12C show cross-sections of the roadway in the positions indicated in the drawing.

The portable roadways according to the present invention are made of a suitable material such as concrete, wood or steel plates, and are constructed in such a way that they can be broken up into sections of desired length. Referring to FIG. 1, there is shown a roadway which has a width of approx. 2 meters and a length of 20 meters and inclines upwards from its center line 0 to both of its sides so that both shoulders thereof are higher than the central portion. and It has pylons 2 installed at intervals of 2 meters along the center line. As the motor cycle is driven in a letter S shaped zigzag configuration across the central groove around each pylon, the driver can learn to compensate or adjust for the changes in the steering gear when the front wheel contacting point on the roadway surface moves at a time of cornering, and when the front fork extends or contracts at a time when the engine is accelerated or decelerated or when the road surface conditions change.

In order to compensate for the specific driving conditions, the driver must maintain a half sitting posture by shifting the center of gravity of the upper half of his body so that he can put himself in a lean-in or lean-out driving position.

FIG. 2 shows a passage having an inverse V-shaped cross section which is inclined downwards from its ridge or center line 0 to both of its sides. When the motor cycle is driven in a letter S shaped zigzag configuration on this roadway, the driver has to drive the motor cycle under an oppositely inclined condition compared to the roadway of FIG. 1. Therefore, unlike the rectilineal driving on a flat surface, the force of driver's arms excerted on the steering gear will change sharply. By driving the motor cycle in lean-in and lean-out postures on this roadway, the driver can learn the techniques of operating the motor cycle perpendicular to the road surface. FIGS. 1—2 shows the cross-section of a roadway having a stepped portion formed in the lengthwise direction thereof. This type of roadway enables the driver to learn how to keep his body balanced by means of the handle when driving the motor cycle in such a manner as to run its front wheel on the upper step and its rear wheel on the lower step.

FIG. 3 shows a roadway having a groove 3 of rectangular cross section formed along its center line 0 and also having pylons 2 installed alternately on both shoulders of the groove at intervals of a definite predetermined distance. The concrete surface should preferrably be covered by steel plates in order to prevent the shoulders of the groove from collapsing. When the motor cycle is driven in a letter S shaped zigzag configuration crossing the central groove around each pylon on this roadway, the stepped portion will become oblique to the running direciton of the motor cycle. Therefore, the front wheel's ground contacting point comes considerably ahead of the rear wheel when traversing the stepped portion, and thus the steering gear receives a shock. Once having passed the stepped portion, the shock once absorbed by the front fork and extension of the fork caused thereby tend to cause the motor cycle to lose its balance. In principle, the driver should drive the motor cycle in such a way as to direct its front wheel at a right angle to the stepped portion, and should open the throttle before the wheel strikes the stepped portion and close it at the moment the wheel has passed over the stepped portion. This type of roadway enables the driver to learn the technique of opening the throttle thereby to accelerate the motor cycle slightly before the rear wheel climbs up the stepped portion and also closing the throttle completely when the rear wheel has completed its climb.

In the embodiment shown in FIG. 4, a plurality of iron pipes 4 are fixedly secured to the surface of roadway 1 in such a manner that they are obliquely and alternately disposed from the left to the right and vice versa. Therefore, if the driver drives a motor cycle in a substantially straight line on this passage, both the front and rear wheels of the motor cycle are liable to spin. For this reason, the motor cycle must be driven at right angles to the iron pipe, so that the track or configuration along which the motor cycle is driven is in the shape of a letter S. Upon traversing this type of passage, the driver opens the throttle at a position in front of the pipe and closes it immediately before the front wheel strikes the pipe. With regard to the rear wheel, the driver advances the motor cycle by its inertia or accelerates it at a position in front of the pipe and closes the throttle when the rear wheel comes into contact with the pipe. It is better for the driver to drive the motor cycle at a reduced speed when passing the pipe, one by one. Driving of the motor cycle on this type of roadway enables the driver to learn the techniques of receiving the shock rhythmically which occurs when riding across the pipe and which is transmitted to his body through the motor cycle and relieving the amount of the shock to be transmitted to the upper half of his body by rhythmically using the spring like motion of his legs and loin rhythmically.

In FIG. 5, there is shown a roadway 1 having a plurality of rollers 5 each being rotatably mounted thereon by means of a roller shaft 5' and bearing portions 5'' provided on both sides thereof. FIGS. 6 and 6—1 show a base plate of roadway 1 having a plurality of balls 6 each having a shaft 6' and being mounted partially below the surface of the base plate so as to rotate freely, and this type of roadway enables the driver to learn the driving techniques the same as that in the case of the roadway shown in FIG. 4.

In FIGS. 7 and 7—1, there is shown a roadway 2 meters wide and 20 meters long having a plurality of inclined steps 7, each having a vertical height of 7 cm formed stepwise at space intervals of 85 cm, the passage being made of concrete having a somewhat roughly finished surface.

The embodiment illustrated in FIGS. 8 and 8—1 is a modification of the embodiment of FIG. 7 wherein vertical steps 8 are employed in place of the inclined steps of FIG. 7. Driving up on these types of roadways enables the driver to learn the techniques of climbing up steps one by one using the inertia of the motor cycle and the upper half of his body and by controlling the accelerator and correcting the balance of the motor cycle due to extension and contraction of the front and rear suspensions by keeping the upper half of his body at a proper posture. The driver can thus learn to shift the upper half of his body in the forward direction at the same time when he opens the accelerator. Immediately thereafter the accelerator should be closed. These roadways according to the two embodiments of the present invention also enables the driver to acquire the technique of descending across stepped obstacles.

FIG. 9 shows a roadway comprising an open top vessel made of steel plates in which gravels 9 are laid to a suitable height, preferrably up to 30 cm. It is desirable to use large grained gravels, and concrete grains each having a diameter of about 10 cm for this purpose. Alternatively, sand may be used. By driving on this type of roadway, the driver can learn how to drive the motor cycle on such a gravelled road where the front wheel becomes partially embedded into the gravel when the speed of the motor cycle is low. This renders the control of the front wheel difficult. The pressure of the air in the tires should be kept low so that the small shock which can not be absorbed by the suspensions of the vehicle and be absorbed by the tires. The motor cycle should be driven at a proper speed by using a gear for somewhat higher speed, and the driver should sit in a half-sitting posture without exerting force on his shoulders and keep both hands gripping the handle and ready to move. By driving on this roadway, the driver can learn the techniques of opening and closing the accelerator a little at a time so as to keep the rear wheel always in a gripped state.

In FIG. 10, there is shown a flat roadway base plate 1 having a width of 1 meter and length of 20 meters which has a groove 20 cm wide and 5 cm deep formed in the central part thereof. It is desirable to cover the surface of the groove with steel plates in order to give the shoulders of the groove sufficient strength and durability. The driver is allowed to drive the motor cycle on this passage under the condition that the front and rear wheels can run only within the straight groove. The groove is narrow in width, and so correction of the steering can not be effected. Therefore, driving on this passage enables the driver to learn the techniques of maintaining a straight driving line by shifting the center of gravity of the upper half of his body to the left and to the right and controlling the accelerator. FIG. 11 shows a modification of the passage of FIG. 10, in which the straight groove is substituted by a letter S shaped groove. By allowing the driver to drive the motor cycle with its front and rear wheels running only within the letter S shaped groove, he can learn balanced driving techniques.

FIG. 12 shows a letter S shaped passage which inclines from one side to the other in its cross section. The protions A, B and C of the roadway incline, in the cross section thereof, downwards and outwardly from the center of curvature different from the other portion thereof. The above portions constitute reversely inclined bank corners which produce poor adhesion of the tires on the surface thereof, and thus they are liable to cause the tires to slip. Therefore, driving on this roadway enables the driver to learn how to maintain his balance which driving by controlling the speed of the motor cycle and keeping his body in a proper posture.

Further, it is possible to form the grooves shown in FIGS. 11 and 12 deeper so as to allow only the rear wheel to run in the grooves. This driving technique is applied under the condition that the rear wheel slips, and so it is suitable for enabling the driver to know the relationship between the opening and shutting of the accelerator and the balancing of his upper half of his body.

By driving the motor cycle on the passages comprising in combination any of the above-mentioned embodiments, according to the present invention, which are set on the ground, the driver can acquire definite fundamental driving techniques when passing through each different roadway, thereby acquiring complicated driving techniques in a short period of time. This means that the driver can drive the motor cycle safely by proper operation, not only on public roads but also on roads to which various restrictions are applied, which contributes to the prevention and occurence of traffic accidents.

Further, when the roadway structure is too bulky, it can be made portable by dividing it in blocks of a proper length so that it can be set at a desired position. Therefore, it is not necessary to install the portable roadways of the present invention in a particular site such as driver's school. Accordingly, it is possible to prevent the occurrence of public hazards due to the noise generated by motor cycles if the passages are installed at a site where no residential house is built.

What we claim is:

1. A portable road-type structure for driver education which can be moved readily from one location to another which comprises a roadway, at least part of the surface of said roadway possessing a V-shape and at least part of the surface of said roadway containing an inverse V-shape, both of said shapes being inclined from the center of the roadway to both of the shoulders thereof, and a plurality of pylons installed in the roadway along the center lines thereof at substantially equally predetermined intervals along the longitudinal direction of the roadway, said portable road-type structure functioning as an educational tool for teaching an individual the fundamental knowledge and techniques for driving a motorcycle before being exposed to actual driving conditions.

2. A portable road-type structure for driver education which can be readily moved from one location to another which comprises a roadway, at least part of the surface of said roadway possessing a stepped portion formed in the longitudinal direction along one side thereof, thereby forming two substantially parallel longitudinal elevations in the surface of the roadway, said portable road-type structure functioning as an educational tool for teaching an individual the fundamental knowledge and techniques for driving a motorcycle before being exposed to actual driving conditions.

3. A portable road-type structure for driver education which can be readily moved from one location to another which comprises a roadway, at least part of the surface of said roadway containing a groove of rectangular cross-section formed along the longitudinal centerline thereof, thereby forming two substantially parallel longitudinal elevations in the surface of the roadway, with the bottom of the groove forming one elevation and the lateral surfaces of the roadway forming the other elevation, said portable road-type structure functioning as an educational tool for teaching an individual the fundamental knowledge and techniques for driving a motorcycle before being exposed to actual driving conditions.

4. The portable road-type structure of claim 3, wherein said roadway is straight in configuration and said groove is also straight in configuration.

5. The portable road-type structure of claim 3, wherein said roadway has a serpentine configuration and said groove has a corresponding serpentine configuration.

6. The portable road-type structure of claim 3, wherein pylons are disposed alternately on both shoulders of the groove at definite, predetermined intervals.

7. The portable road-type structure of claim 6, wherein the roadway is made of concrete covered by steel plate in order to prevent the shoulder of the groove from collapsing.

8. A portable road-type structure for driver education which can be readily moved from one location to another which comprises a roadway, at least part of the surface of said roadway containing metal pipes which are fixedly embedded in said roadway diagonally and alternately in opposite directions across the roadway, along the longitudinal direction thereof, said portable road-type structure functioning as an educational tool for teaching an individual the fundamental knowledge and techniques for driving a motorcycle before being exposed to actual driving conditions.

9. A portable road-type structure for driver education which can be readily moved from one location to another which comprises a roadway, at least part of the surface of said roadway containing a plurality of rollers rotatably mounted across the surface thereof, substantially perpendicular to the longitudinal direction of said roadway, said rollers being spaced apart from each other a predetermined distance, said portable road-type structure functioning as an educational tool for teaching an individual the fundamental knowledge and techniques for driving a motorcycle before being exposed to actual driving conditions.

10. A portable road-type structure for driver education which can be readily moved from location to another which comprises a roadway, at least part of the surface of said roadway containing a plurality of balls rotatably mounted in the surface thereof, at least a portion of the surface of said balls extending above the surface of the roadway, said portable road-type structure functioning as an educational tool for teaching an individual the fundamental knowledge and techniques for driving a motorcycle before being exposed to actual driving conditions.

11. A portable road-type structure for driver education which can be readily moved from one location to another which comprises a roadway, at least part of the surface of said roadway containing a plurality of spaced-apart inclined steps, thereby providing a surface with multiple elevations, said portable road-type structure functioning as an educational tool for teaching an individual the fundamental knowledge and techniques for driving a motorcycle before being exposed to actual driving conditions.

12. A portable road-type structure for driver edcuation which can be readily moved from one location to another which comprises a roadway, at least part of the surface of said roadway containing a plurality of spaced-apart steps, thereby providing a surface with multiple elevations, said portable road-type structure functioning as an educational tool for teaching an individual the fundamental knowledge and techniques for driving a motorcycle before being exposed to actual driving conditions.

13. A portable road-type structure for driver education which can be readily moved from one location to another which comprises a roadway, at least part of the surface of said roadway comprising an open-top, rectangularly shaped, metal vessel containing large grained gravel or sand which forms the surface of said roadway, said portable road-type structure functioning as an educational tool for teaching an individual the fundamental knowledge and techniques for driving a motorcycle before being exposed to actual driving conditions.

14. A portable road-type structure for driver education which can be readily moved from one location to another which comprises a roadway, at least part of the surface of said roadway having a serpentine configuration with the surface thereof inclining in cross section from one side of the roadway to the other side thereof, said portable road-type structure functioning as an educational tool for teaching an individual the fundamental knowledge and techniques for driving a motorcycle before being exposed to actual driving conditions.

15. The portable road-type structure of claim 14, wherein various sections of the roadway along its longitudinal length, in cline in different amounts downwardly and outwardly from the center of curvature of the roadway.

* * * * *